US005591249A

United States Patent [19]

Hankins

[11] Patent Number: 5,591,249

[45] Date of Patent: Jan. 7, 1997

[54] FLUE GAS CONDITIONING METHOD FOR INTERMITTENTLY ENERGIZED PRECIPITATION

[75] Inventor: William G. Hankins, Issaquah, Wash.

[73] Assignee: The Chemithon Corporation, Seattle, Wash.

[21] Appl. No.: 626,016

[22] Filed: Mar. 22, 1996

Related U.S. Application Data

[63] Continuation of Ser. No. 254,937, Jun. 7, 1994, abandoned.

[51] Int. Cl.[6] ..... B03C 3/013

[52] U.S. Cl. ..... 95/6; 95/7; 95/58; 95/81; 96/23; 96/52; 96/80

[58] Field of Search ..... 95/6, 7, 58, 80, 95/81, 2; 96/22–24, 52, 74, 80, 82; 323/903; 110/216, 217, 345; 423/242.1

[56] References Cited

U.S. PATENT DOCUMENTS

| | | | |
|---|---|---|---|
| 2,864,456 | 12/1958 | Hall et al. | 96/21 |
| 3,686,825 | 8/1972 | Busby | 239/566 X |
| 4,042,348 | 8/1977 | Bennett et al. | 423/215.5 X |
| 4,284,417 | 8/1981 | Reese et al. | 95/3 |
| 4,390,831 | 6/1983 | Byrd et al. | 323/240 |
| 4,490,159 | 12/1984 | Matts | 95/3 |
| 4,533,364 | 8/1985 | Altman et al. | 423/215.5 X |
| 4,613,346 | 9/1986 | Reyes et al. | 95/3 |
| 4,624,685 | 11/1986 | Lueckenotte et al. | 323/903 X |
| 4,659,342 | 4/1987 | Lind | 323/903 X |
| 4,746,331 | 5/1988 | Truce | 95/2 |
| 4,770,674 | 9/1988 | Tellini et al. | 422/160 X |
| 4,779,207 | 10/1988 | Woracek et al. | 364/500 |
| 4,793,268 | 12/1988 | Kukin et al. | 110/343 |
| 4,844,723 | 7/1989 | Tellini et al. | 423/533 X |
| 4,885,139 | 12/1989 | Sparks et al. | 422/169 |
| 4,966,610 | 10/1990 | Krigmont et al. | 95/58 |
| 4,987,839 | 1/1991 | Krigmont et al. | 110/345 X |
| 5,032,154 | 7/1991 | Wright | 422/109 |
| 5,122,162 | 6/1992 | Krigmont et al. | 95/2 |
| 5,288,303 | 2/1994 | Woracek et al. | 95/6 X |
| 5,288,309 | 2/1994 | Wright | 96/22 |

FOREIGN PATENT DOCUMENTS

| | | |
|---|---|---|
| 0450357A1 | 9/1991 | European Pat. Off. . |
| 1610928/26 | 8/1977 | U.S.S.R. . |

OTHER PUBLICATIONS

E. C. Landham, Jr. et al., *Pilot–Scale Evaluation of ESP Intermittent Energization,* undated, pp. 1–11 (+4 pages of figures).

Takashi Ando et al., *A New Energization Method for Electrostatic Precipitators Mitsubishi Intermittent Energization System,* presented at the Fourth Symposium on the Transfer and Utilization of Particulate Control Technology, Houston, Texas, Oct. 11–15, 1982, pp. 38–52.

Kjell Porle et al., *Long–Term Experience with Pulsed Energization of ESP's at a Danish Power Station,* presented at the Sixth Symposium on the Transfer and Utilization of Particulate Control Technology, vol. 2, New Orleans, Louisiana, Feb. 25–28, 1986, pp. 23–37.

Norman O. Wagoner, David L. Woracek, *Flue Gas Conditioning—Recent Experience with $SO_3$,* pp. 1–6 (+4 pages of figures and tables), published in Power Engineering in approximatley Sep., 1987.

John Wendling, *Intermittent Energization Reduces Power Consumption, Emissions for Oklahoma Gas & Electric,* Innovators with EPRI Technology, Aug., 1992.

Mark VII Controller Wiring Schematic, undated.

*Primary Examiner*—Richard L. Chiesa

*Attorney, Agent, or Firm*—Marshall, O'Toole, Gerstein, Murray & Borun

[57] ABSTRACT

A method is used for preconditioning flue gas to be treated in an electrostatic precipitator having a set of electrostatic elements which are intermittently energized by a power supply. The method uses a current sensor and a voltage sensor to detect the current and the voltage supplied to the electrostatic elements during an energized half-cycle of the power delivered to the electrostatic precipitator and develops an indication of the intermittent power supplied to the electrostatic elements from the current and voltage sensor measurements. The amount of a conditioning agent added to the flue gas is controlled to maintain the power indication at a substantially predetermined level.

15 Claims, 4 Drawing Sheets

FLUE GAS CONDITIONING METHOD FOR INTERMITTENTLY ENERGIZED PRECIPITATION

This is a Continuation of U.S. application Ser. No. 08/254,937, filed Jun. 7, 1994, now abandoned.

FIELD OF THE INVENTION

The present invention relates to a system for conditioning flue gas with a conditioning agent such as $SO_3$ in order to improve the efficiency of an electrostatic precipitator in collecting ash and other particulate matter from the flue gas, and more particularly, to such a system which is controlled by monitoring the power delivered to the electrostatic elements of an electrostatic precipitator.

BACKGROUND OF THE INVENTION

The flue gas of furnaces and boilers, such as those used in power generation plants, carries matter including ash and other particulates which pollute the atmosphere. Electrostatic precipitators are used to remove ash and other particulates carried in the flue gas. Electrostatic precipitators operate by causing the individual particles in the flue gas to accept an electrical charge and by attracting the charged particles to collector plates for disposal.

Electrostatic precipitation has been used primarily in connection with the burning of coal. As coal burns, it produces $H_2O$, $CO_2$, CO, $SO_2$, $SO_3$, ash and other particulate matter and products of combustion. The $H_2O$ and $SO_3$ combine to form $H_2SO_4$ (sulfuric acid) which coats the particulate matter. The coating of $H_2SO_4$ reduces the resistance of the ash and other particulate matter and thereby facilitates the electrical charging of this particulate matter so that the charged particulate matter can be more easily attracted to the collector plates of the electrostatic precipitator. If combustion produces insufficient $H_2SO_4$, however, the resistance of the particulate matter is high which reduces the efficiency of the electrostatic precipitator in charging the particulate matter suspended in the flue gas and, as a result, in collecting particulate matter from the flue gas.

When coal having a relatively high sulfur content is burned, sufficient $SO_3$ is produced to form the proper amount of $H_2SO_4$. However, high sulfur coal also produces excess $SO_2$ which, if exhausted to the atmosphere, is a pollutant that has been linked to acid rain.

In order to reduce $SO_2$ emissions, the operators of coal fired boilers and furnaces have burned coal having a low sulfur content. However, low sulfur coal results in the production of less $SO_3$ than that required to efficiently operate the electrostatic precipitators. Accordingly, one must balance the need for lower $SO_2$ emissions and the need for an adequate supply of $SO_3$ to maintain the efficiency of electrostatic precipitators at a relatively high level. To provide this balance, the operators using lower sulfur content coal have injected a controlled amount of $SO_3$ into the flue gas to compensate for the inadequate amount of $SO_3$ produced by combustion of the low sulfur coal. Thus, $SO_2$ emissions are held relatively low while electrostatic precipitator efficiency is increased.

As is apparent, the efficiency of some electrostatic precipitators is dependent upon the concentration of $SO_3$ in the flue gas. That is, if the $SO_3$ concentration in the flue gas is too low, an electrostatic precipitator may operate at less than optimal efficiency and an unacceptable plume of particulates may result. Flue gas that has less than optimal $SO_3$ concentrations as the flue gas enters the electrostatic precipitator constitutes an emissions problem. Coal fired power generation plants that are operating out of compliance with emission regulations can be forced to reduce their power output until the emissions are brought back into compliance. Accordingly, it is important to keep the emissions concentrations within an acceptable range while minimizing the power consumption of the electrostatic precipitator.

One prior art method of decreasing the power consumption of an electrostatic precipitator is to measure the opacity of the flue gas as it exits from a stack of the flue gas conditioning system and to control the amount of power supplied to the electrostatic precipitator accordingly. For example, Reese, et al., U.S. Pat. No. 4,284,417 discloses a system for controlling the electric power supplied to an electrostatic precipitator having an opacity-sensitive transducer which produces an output signal proportional to the opacity of the flue gas exiting from the precipitator. The system also includes a comparator which compares the output signal with preset upper and lower limits and a controller which controls the power supplied to the precipitator in order to restore the flue gas opacity to a permissible range when the output signal falls outside of the preset upper and lower limits. Krigmont, et al., U.S. Pat. No. 4,987,839 discloses a system including a source of $SO_3$ which adds $SO_3$ to flue gas before it enters an electrostatic precipitator and a controller which controls the rate at which the $SO_3$ is added to the flue gas. The controller is responsive to the opacity of the flue gas exiting the electrostatic precipitator and to the power supplied to the electrostatic precipitator.

Measuring the opacity of the flue gas as it leaves the flue gas conditioning system, however, is not necessarily the best method of controlling the level of ash and other particulates in flues because the opacity of the flue gas is not a good indicator of the need for the addition of a particular additive, such as $SO_3$.

Another method of increasing the efficiency of an electrostatic precipitator is to employ, as a control for the amount of $SO_3$ delivered to the flue, the power delivered to the electrostatic precipitator. A system employing this method is disclosed in Woracek, et al., U.S. Pat. No. 4,779,207, wherein a flue gas conditioning system includes automatic voltage controllers (AVCs) which supply power to transformer/rectifier sets which, in turn, provide a stepped-up and rectified voltage to elements or plates of an electrostatic precipitator. Power measuring elements produce signals indicative of the power delivered by each of the AVCs to each of the transformer/rectifier sets, and these signals are combined to produce an indication of the average power delivered to the electrostatic precipitator. The average power indication is used to control the amount of $SO_3$ delivered to the flue so as to keep the average power delivered to the electrostatic precipitator within a predetermined range.

It is also known in the prior art to intermittently energize the elements of an electrostatic precipitator, which may include plates, electrodes and the like, in order to increase the electrostatic precipitator efficiency. A flue gas conditioning system which is utilized for an electrostatic precipitator system with intermittent energization typically has an AVC which supplies an intermittent voltage, having a predetermined duty cycle, to a transformer/rectifier circuit which, in turn, provides a stepped-up, rectified, intermittent voltage to the electrostatic elements. Krigmont, et al., U.S. Pat. No. 4,987,839 discloses an intermittently energized system having a control which is responsive to the duty cycle of the power delivered to an electrostatic precipitator and which uses this duty cycle to estimate the power delivered to the flue gas by the electrostatic elements.

Intermittent energization, however, creates a control problem in flue gas conditioning systems like that disclosed in the Krigmont, et al. patent and those which control the amount of $SO_3$ delivered to the flue in accordance with a power signal developed from the duty cycle of the intermittent power supplied to the electrostatic precipitator. This problem occurs because neither (a) the duty cycle of the intermittent power nor (b) the actual power developed by the precipitator power source with which the flue gas conditioning system is used, are reliable indications of the power actually delivered to the flue gas by the electrostatic elements. As such, an average power signal developed from the duty cycle of the intermittent power is an inaccurate determination of the amount of $SO_3$ which needs to be provided to the flue gas entering the electrostatic precipitator. This problem becomes particularly acute when the duty cycle of the power source is periodically changed during operation of the flue gas conditioning system. In such a system, therefore, other means must be provided for measuring the power absorbed by the electrostatic elements of the electrostatic precipitator.

SUMMARY OF THE INVENTION

The power absorbed by the electrostatic elements of an electrostatic precipitator is an indication of the resistivity of the particulate matter within a flue and, therefore, the need for $SO_3$. When a flue gas conditioning system is operated in a constant energization mode, one may normally use the power developed by a power source and delivered to the electrostatic precipitator as an accurate measure of the power absorbed by the electrostatic elements and, therefore, as a reliable indicator of the amount of flue gas conditioning agent ($SO_3$) required to treat the particulates in the flue gas.

If the electrostatic elements of the electrostatic precipitator are intermittently energized, however, the power developed by the power source and the duty cycle of the intermittent energization are not reliable indications of the power absorbed by the electrostatic elements. Therefore, when intermittent energization is employed, other means must be provided for measuring the power absorbed by the electrostatic elements. According to one embodiment of the present invention, certain parameters of the power delivered directly to the electrostatic elements are measured, and these parameters are used to develop a power signal which, in turn, is used to regulate the amount of $SO_3$ delivered to the flue gas.

Thus, the present invention relates to a system for preconditioning flue gas to be treated in an intermittently energized electrostatic precipitator having a power source which supplies an intermittent power to electrostatic elements of an electrostatic precipitator. One aspect of this system includes a source of a conditioning agent, such as $SO_3$, and a detection device which detects first and second parameters of the power supplied to the electrostatic elements. The system also includes a component which is responsive to the first and second parameters, and which develops an indication of the power supplied to the electrostatic elements. In addition, the system includes a controller, responsive to the power indication, which controls the amount of conditioning agent added to the flue gas in order to maintain the power at a substantially predetermined level.

The power source may include circuitry for delivering an intermittent voltage to a primary winding of a transformer having a transformer output coupled to the electrostatic elements. The power source may also include a circuit for selecting the intermittent duty cycle delivered to the transformer.

The detection device may include a current sensor for measuring the current flowing through the transformer input or the transformer output and a voltage sensor for measuring the voltage at the transformer input or the transformer output. Specifically the current sensor may include circuitry for measuring the half-cycle root mean squared (RMS) current, the peak current or the average current flowing through the transformer during one or more energized half-cycles of the intermittent power, while the voltage sensor may include circuitry for measuring the average voltage, the peak voltage, the half-cycle RMS voltage or the minimum voltage across transformer during one or more energized half-cycles of the intermittent power. Preferably, a multiplier multiplies the RMS, peak or average current with the average, peak, RMS or minimum voltage to produce the power indication.

Another aspect of the present invention is directed to an improvement in a flue gas conditioning system in which a source of a conditioning agent is added to flue gas, and in which an electrostatic precipitator, having a set of electrostatic elements which receive a power, treats the flue gas. Furthermore, a controller, responsive to an indication of the power, controls the amount of the conditioning agent added to the flue gas, and a power source, which operates in an intermittent energization mode, delivers a power having a duty cycle to the electrostatic elements. The improvement includes a measuring device which measures first and second parameters of the power delivered to the electrostatic elements, and circuitry, responsive to the first and second parameters, which derives the indication of the power.

Preferably, the first and second parameters are current and voltage, respectively, and the measuring device includes a first sensor which detects current flowing into the electrostatic elements to produce a current signal and a second sensor which detects voltage developed across the electrostatic elements to produce a voltage signal. The circuitry combines the current signal and the voltage signal to produce the indication of the power.

Yet another aspect of the present invention is directed to a method of controlling a flue gas conditioning system which includes a source of a conditioning agent, a component which adds the conditioning agent to flue gas, and an electrostatic precipitator having a set of electrostatic elements which receive a power, for treating the flue gas. The system further includes a controller, responsive to a signal indicative of the power, which controls the amount of conditioning agent added to the flue gas. According to one embodiment of the method, a power source is operated in an intermittent energization mode to develop an input power having a duty cycle which delivers the power to the electrostatic elements. Furthermore, first and second parameters of the power are measured and are used to derive the signal indicative of the power.

These and other features and advantages will become more apparent from a detailed consideration of the invention when taken in conjunction with the following drawings.

DETAILED DESCRIPTION OF THE PREFERRED EMBODIMENT

Figure 1:
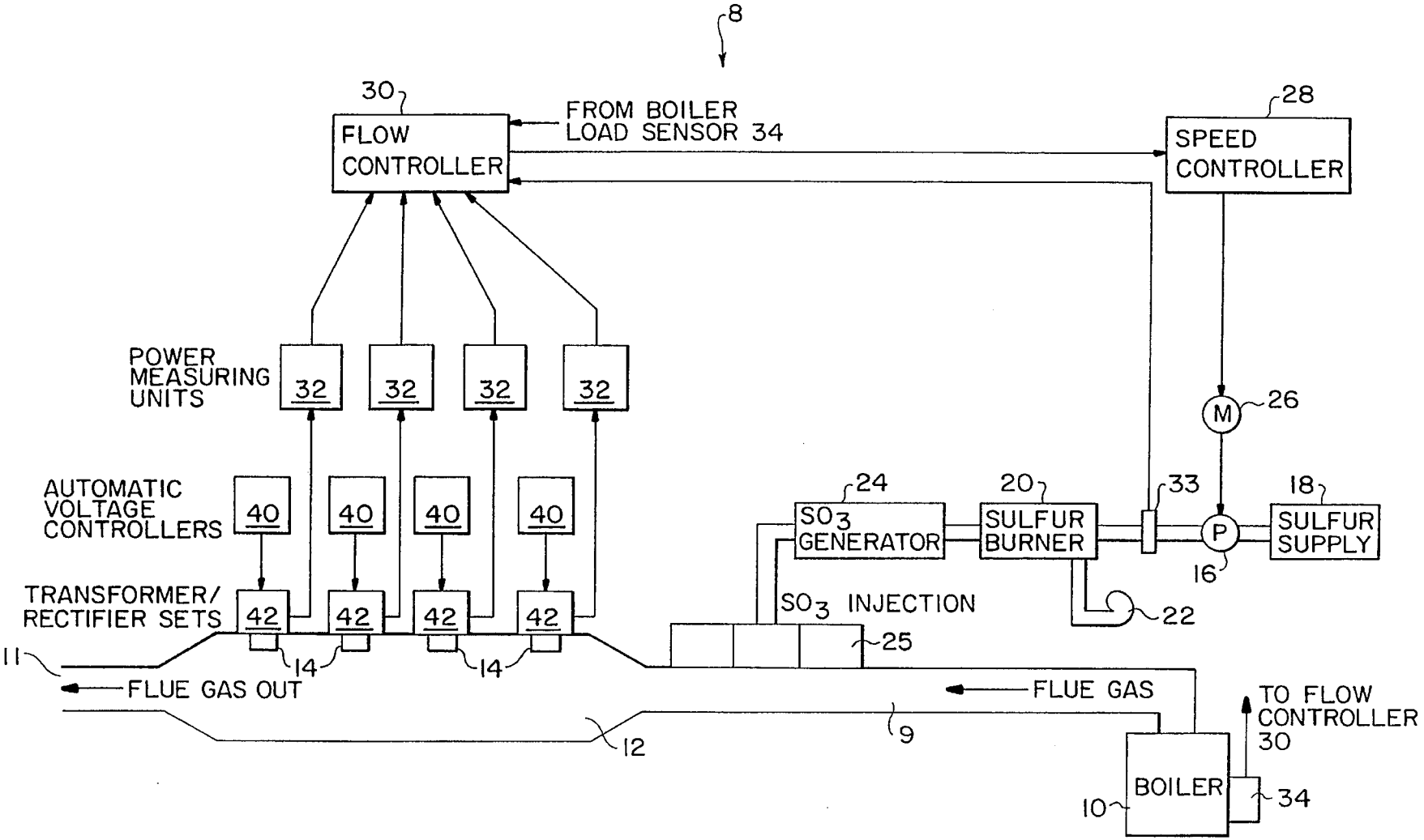
FIG. 1 comprises a block diagram of a flue gas exhaust and conditioning system according to an embodiment of the present invention.

Referring initially to FIG. 1, a flue gas conditioning system is indicated generally at 8 and is used with a flue 9 connected to a boiler 10, such as a boiler in a coal burning power generation plant, which discharges by-products of combustion through flue 9. An electrostatic precipitator 12 is disposed in flue 9 and has multiple sets of electrostatic elements 14, which include electrodes and/or electrostatic plates, which are disposed parallel to the flow of the flue gas through the flue 9, for removing ash and other particulate material from the flue gas.

In order to increase the efficiency of electrostatic precipitator 12 in precipitating out the ash and other particulate matter from the flue gas in flue 9, a conditioning agent in the form of gaseous sulfur trioxide, $SO_3$, is supplied to the flue gas in flue 9. This $SO_3$ is produced by burning sulfur with oxygen to produce sulfur dioxide, $SO_2$, and then converting the $SO_2$, by the use of a catalytic converter, into $SO_3$ which then can be supplied to flue 9. Accordingly, a pump 16 delivers molten sulfur provided by a sulfur supply 18 to a sulfur burner 20 which burns the sulfur in the presence of oxygen in order to produce sulfur dioxide, $SO_2$. Oxygen is supplied to the burner 20 in the form of air from an air blower 22. A gas mixture including $SO_2$ exits the sulfur burner 20 and is supplied to an $SO_3$ generator 24, such as a catalytic converter, which converts the sulfur dioxide, $SO_2$, into sulfur trioxide, $SO_3$, typically by employing excess oxygen in the mixture exiting sulfur burner 20. $SO_3$ generator 24 delivers $SO_3$ to a set of injectors 25 which inject the $SO_3$ into flue 9 where the $SO_3$ combines with water vapor in the flue gas to form sulfuric acid vapor which condenses and reacts with the ash and other particulate material in flue 9. This process reduces the resistivity of the particles in the flue gas and allows electrostatic elements 14 of electrostatic precipitator 12 to remove the particles more efficiently. Burning sulfur in the presence of oxygen to form sulfur dioxide and then converting that sulfur dioxide into sulfur trioxide may all be done in a conventional manner.

Pump 16 is driven by a motor 26 under control of a speed controller 28. Speed controller 28 is regulated by a flue gas flow controller 30 which is responsive to a set of power signals developed by power measuring units 32 which provide an indication of the requirement of $SO_3$ within the flue. Flow controller 30 may also be responsive to a flow signal produced by a flow rate sensor 33, connected between pump 16 and burner 20. Sensor 33 produces a signal indicative of the actual amount of sulfur being supplied to burner 20. Flow controller 30 may also be responsive to a boiler load signal from a sensor 34 which reflects the amount of combustion occurring in boiler 10.

A set of automatic voltage controllers (AVCs) 40 provide power in the form of AC voltage to a set of transformer/rectifier (T/R) sets 42, each of which includes a transformer and a rectifier and each of which is connected to one of the sets of electrostatic elements 14. Each of T/R sets 42 steps up the voltage supplied by the associated AVC 40 to produce a higher amplitude secondary voltage, rectifies the secondary voltage, and provides the rectified secondary voltage to the associated electrostatic elements 14, which remove ash and other particulate matter from the flue gas in electrostatic precipitator 12.

Power measuring units 32 are responsive to signals indicative of the voltage and current delivered to electrostatic elements 14 by T/R sets 42, and units 32 produce power signals indicative of the power absorbed by electrostatic elements 14. The power signals produced by power measuring units 32 are preferably indicative of the average power delivered to electrostatic elements 14 during each cycle or half-cycle of the AC voltage developed by AVCs 40, but could, alternatively, comprise instantaneous power signals, power signals indicative of the average power absorbed by the electrostatic elements 14 over longer periods of time, or any other type of power signal, if so desired. Flow controller 30 is responsive to the power signals developed by each of the power measuring units 32 and produces an electrostatic precipitator power signal indicative of the total average power absorbed by all of the sets of electrostatic elements 14 over a predetermined length of time.

Flow controller 30 uses the electrostatic precipitator power signal as a process value to control the speed controller 28. This control can be accomplished by comparing an electrostatic precipitator power signal process value to a power set point to produce a difference signal. If the electrostatic precipitator process value is greater than the set point, the flow controller 30 causes speed controller 28 to decrease the amount of sulfur being provided by sulfur supply 18 to burner 20 and decrease the amount of $SO_3$ injected at injectors 25, which increases the resistivity of the particles in the flue gas, and thereby decreases the power absorbed by the electrostatic elements. If, however, the electrostatic precipitator process value is below the set point value, flow controller 30 causes the speed controller to increase the amount of sulfur being provided by sulfur supply 18 to burner 20 and increase the amount of $SO_3$ injected at injectors 25, which reduces the resistivity of the particles in the flue gas and thereby increases the power absorbed by the electrostatic elements. In this manner, flow controller 30 measures the power dissipated by electrostatic elements 14 and regulates the speed of motor 26 to ensure that the proper amount of sulfur trioxide, $SO_3$, is supplied to flue 9 so as to maintain a substantially constant power usage within electrostatic elements 14 of the electrostatic precipitator 12.

Flow controller 30 shown in FIG. 1 may be a programmable logic controller such as a Honeywell UDC 9000E which delivers a 4 to 20 milliamp signal to speed controller 28 which may be any suitable speed controller, such as a Westinghouse Acutrol Model 110, for accepting a 4 to 20 milliamp input and for providing a speed control output to motor 26. Each of AVCs 40 shown in FIG. 1 may be, for example, an ABB Fläkt, Epic II automatic voltage controller system.

The amount of $SO_3$ supplied to flue 9 is proportional to the sulfur supplied to the burner 20 by pump 16 which is controlled by the speed of motor 26. In one embodiment, the amount of air from blower 22, which provides the oxygen for forming $SO_2$ and $SO_3$, can be preset to comprise a constant flow of air sufficient to produce the required supply of oxygen at maximum $SO_3$ demand. In another embodiment, air flow from blower 22 can be varied in response to variations in the amount of sulfur delivered by sulfur pump 16. Typically, in both embodiments, there is always a surplus of air flow to burner 20 and to $SO_3$ generator 24 to deliver to flue 9, a dilute mixture of gaseous $SO_3$.

Figure 2:
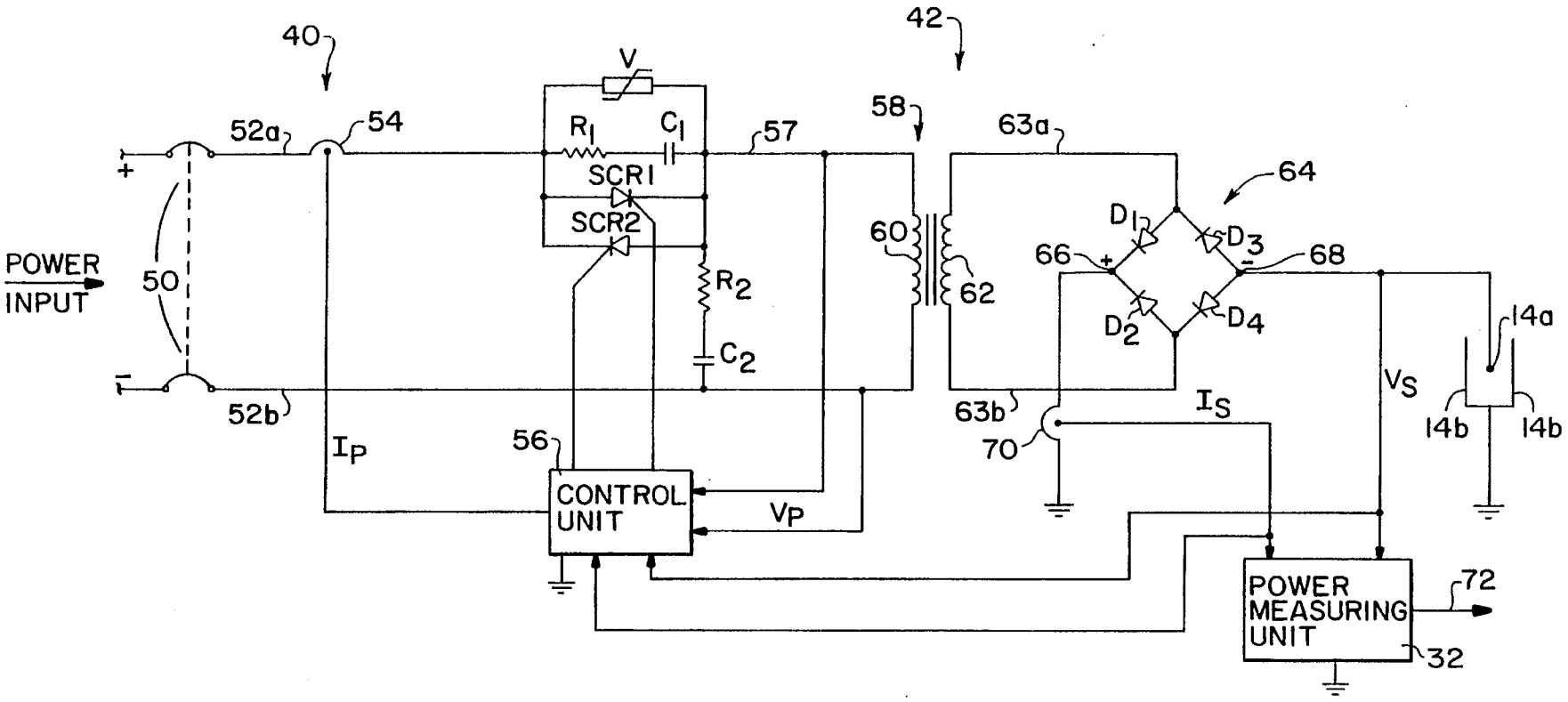
FIG. 2 comprises a combined block and simplified schematic diagram of a portion of the system of FIG. 1.

FIG. 2 illustrates one AVC 40 in conjunction with one T/R set 42 and one power measuring unit 32. An AC input voltage, typically having an RMS voltage of 480, is produced by an external power source (not shown) and is supplied through a circuit breaker 50 to lines 52*a* and 52*b*. A current sensor 54 produces a primary current signal $I_p$, indicative of the current flowing through line 52*a* and into AVC 40, which is delivered to an AVC control unit 56. The power developed on line 52*a* is provided to silicon controlled rectifiers SCR1 and SCR2 which are connected between line 52*a* and a line 57, in a reverse parallel configuration. AVC control unit 56 is coupled to the gate inputs of SCR1 and SCR2 and controls the operation thereof.

A varistor V and a resistor R1 in conjunction with a capacitor C1 are connected in parallel across silicon controlled rectifiers SCR1 and SCR2, while a resistor R2 and a capacitor C2 are connected in series between the cathode of SCR1 and line 52*b*. Varistor V, resistors R1 and R2 and capacitors C1 and C2 operate as a protection circuit which filters out transients produced by SCR1 and SCR2 when switching from an on state to an off state, or vice-versa. This protection circuit prevents, for example, SCR1 from turning SCR2 on when SCR1 turns off. The values of varistor V, resistors $R_1$ and $R_2$ and capacitors $C_1$ and $C_2$ are dependent upon the particular type of silicon controlled rectifier used and may be chosen in any conventional manner.

The cathode of SCR1 and the anode of SCR2 are connected through line 57 to an input of a transformer 58 having a primary winding 60 and a secondary winding 62. Transformer 58 steps up the voltage appearing between lines 52*b* and 57 to a higher, secondary level to produce a stepped-up voltage across lines 63*a* and 63*b*, which may comprise a transformer output. Transformer 58 may, however, include a rectifier 64 connected in a full-bridge configuration having diodes D1–D4 connected as shown in FIG. 2. Rectifier 64 is responsive to the stepped-up voltage appearing across lines 63*a* and 63*b* and produces a secondary voltage $V_s$ across a positive transformer output 66 and a negative transformer output 68. Positive transformer output 66 is connected to an electrical ground while negative transformer output 68 is connected to a discharge electrode 14*a* comprising one or more of a plurality of electrodes associated with one of the sets of electrostatic elements 14. Electrostatic plates 14*b*, which comprise the other of the plurality of electrodes within one of the sets of electrostatic elements 14, are connected to electrical ground.

According to one embodiment of the present invention, power measuring unit 32 is responsive to secondary voltage $V_s$ appearing across transformer outputs 66 and 68 and to a current signal $I_s$, produced by a current sensor 70 connected to positive transformer output 66. Power measuring unit 32 produces one signal, indicative of, for example, the root mean squared (RMS) current, the peak current or the average current flowing through the electrostatic elements 14 during one or more predetermined number of energized half-cycles of the input voltage. Power measuring unit 32 also produces a second signal indicative of, for example, the average voltage, the peak voltage, the RMS voltage or the minimum voltage appearing across electrostatic elements 14 during one or more predetermined number of energized half-cycles of the input voltage.

It should be noted, however, that power measuring unit 32 can also be connected across the primary winding 60 of the transformer 58 to measure the current and voltage during one or more energized half-cycles of the input voltage. For example, the power measuring unit 32 can measure the RMS, peak or average current flowing through the primary winding 60 of the transformer 58 during each energized half-cycle of the input voltage and measure the average, peak, RMS or minimum voltage appearing across the primary winding 60 over one or more predetermined number of energized half-cycles of the input voltage in order to measure the power being delivered to the electrostatic elements Power measuring unit 32 combines the RMS, peak or average current signal and the average, peak, RMS or minimum voltage signal by multiplication, for example, to produce a signal indicative of the instantaneous, average or other power delivered to the electrostatic elements 14. Preferably, however, voltage values which are below a preset threshold are not used to derive this power signal. Also preferably, the power measuring unit 32 develops a power signal which represents the power delivered to electrostatic elements 14 during each energized half-cycle or full cycle of the input voltage appearing across lines 52*a* and 52*b*. However, the power measuring unit 32 may develop a power signal which represents the power delivered to the electrostatic elements over longer periods of time, if so desired. In any event, power measuring unit 32 delivers the power signal to flow controller 30 via a line 72.

In operation, the input voltage is delivered to lines 52*a* and 52*b* and thereby to silicon controlled rectifiers SCR1 and SCR2. Control unit 56 responds to current signal $I_p$, to primary voltage $V_p$ appearing across primary winding 60 of transformer 58, to secondary voltage $V_s$, and to secondary current signal $I_s$, and produces control signals at the gate inputs of SCR1 and SCR2. These control signals turn SCR1 and SCR2 on and off and thereby control the voltage delivered to transformer 58.

More specifically, control unit 56 provides a control signal to the gate input of SCR1 which turns SCR1 on during the positive half-cycles of the input voltage appearing between lines 52*a* and 52*b* and which turns SCR1 off during the negative half-cycles of the input voltage. Likewise, control unit 56 provides a control signal to the gate input of SCR2 which turns SCR2 on during the negative half-cycles of the input voltage and which turns SCR2 off during the positive half-cycles of the input voltage.

Control unit 56 controls the specific amount of power delivered to transformer 58 by controlling the exact turn-on time of SCR1 and SCR2 during any particular half-cycle of the input voltage. Control unit 56, for example, turns SCR1 on at the beginning of a particular positive half-cycle of the input voltage in order to deliver maximum power to transformer 58 and to produce a maximum peak voltage across secondary winding 62 of transformer 58 during that particular half-cycle. Control unit 56, however, turns SCR1 on later in a particular positive half-cycle of the input voltage in order to supply less power to transformer 58 and to produce a lower peak voltage across secondary winding 62 of transformer 58 which, in turn, results in less power being delivered to the electrostatic elements 14. Thus, turning SCR1 on later during a particular half-cycle of the input voltage results in less power being delivered to transformer 58 which, in turn, results in less power being delivered to electrostatic elements 14. SCR1 and SCR2 automatically unlatch or turn off at the end of each half-cycle of the input voltage, i.e., when the input voltage goes through the zero point. In this manner, AVCs 40, in conjunction with T/R sets 42, supply a controlled pulsating DC power to the electrostatic elements 14.

Figure 3:
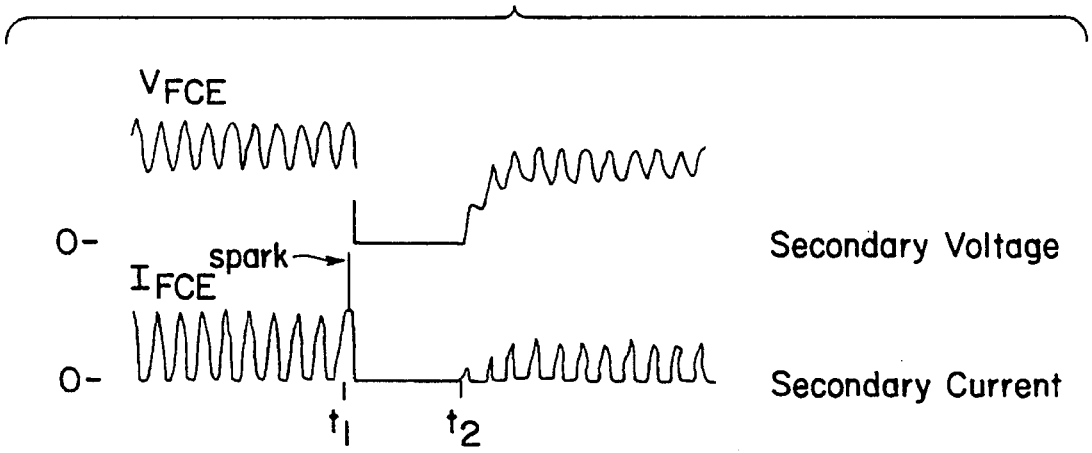
FIG. 3 comprises a set of waveform diagrams illustrating the operation of the system of FIG. 1 in a full-cycle energization mode.

AVCs 40 in conjunction with T/R sets 42 may be operated in a full-cycle energization mode as is commonly known in the prior art. The waveform diagrams shown in FIG. 3 illustrate a voltage signal $V_{FCE}$ and a current signal $I_{FCE}$ which represent the voltage and the current at the output of a T/R set 42 when an AVC 40 operates in a full-cycle energization mode, i.e., when electrostatic elements 14 are energized during all the positive half-cycles and the negative half-cycles of the input voltage. Voltage signal $V_{FCE}$ and the current signal $I_{FCE}$, therefore, represent parameters of power delivered to an electrostatic element 14 of electrostatic precipitator 12. As illustrated in FIG. 3, AVC 40 gradually increases the peak voltage supplied to T/R set 42 over a plurality of input voltage half-cycles until the control unit 56 detects a spark within electrostatic precipitator 12. At this time, shown in FIG. 3 as a time T1, voltage signal $V_{FCE}$ drops to a value of zero while current signal $I_{FCE}$ increases until the end of that particular half-cycle and then drops to a value of zero. After a spark occurs in a particular set of electrostatic elements 14, the associated AVC 40 does not supply voltage to the associated T/R set 42 for a predetermined period of time. This delay allows the ionized path created by the spark to dissipate and prevents continuous sparking or sustained arcing within the particular set of electrostatic elements 14. At a time T2, AVC 40 begins to supply low amplitude voltage to the associated T/R set 42 and gradually increases the peak of the supplied voltage over a plurality of half-cycles until another spark occurs within the associated set of electrostatic elements 14. Each AVC 40 repeats this cycle so as to energize electrostatic elements 14 in a full-cycle energization mode.

Figure 4:
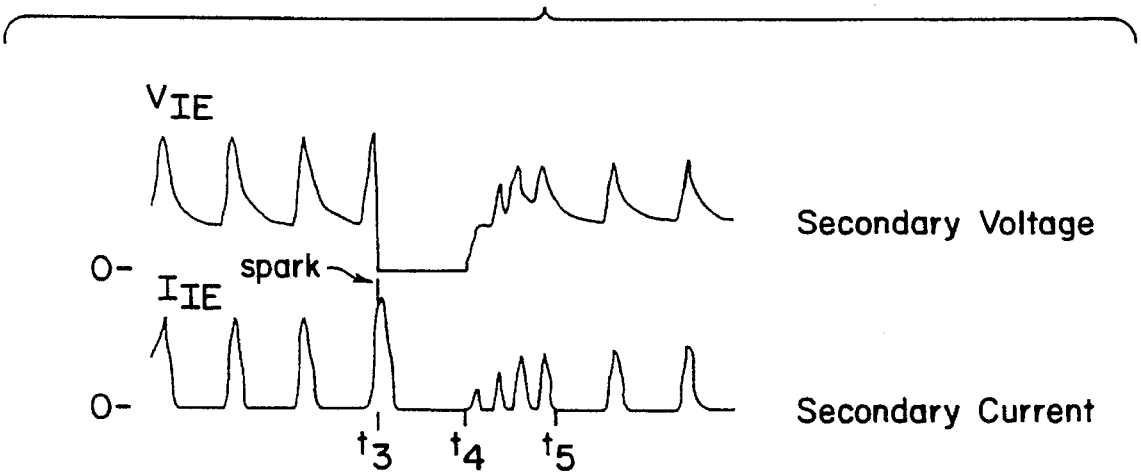
FIG. 4 comprises a set of waveform diagrams illustrating the operation of the system of FIG. 1 in an intermittent energization mode.

It has been found, however, that the performance of electrostatic precipitator 12 can be improved and/or power can be saved, when AVCs 40 operate in an intermittent energization mode. During the intermittent energization mode, each AVC 40 provides voltage to associated T/R set 42 during some half-cycles (which may include both positive and negative half-cycles) of the input voltage while skipping other half-cycles. FIG. 4 illustrates a voltage signal $V_{IE}$ and a current signal $I_{IE}$ which represent the voltage and current appearing at the output of T/R set 42 when the associated AVC 40 operates in an intermittent energization mode, having a duty cycle of 33% (i.e., one half-cycle on and two half-cycles off). During the intermittent energization mode, the AVC 40 increases the voltage delivered to associated T/R set 42 until a current or voltage limit is reached or until a spark occurs within electrostatic elements 14. At that time, illustrated in FIG. 4 as a time T3, voltage signal $V_{IE}$ drops to a value of zero while current signal increases until the end of that particular half-cycle and then drops to a value of zero. After the spark occurs, AVC 40 does not provide voltage to T/R set 42 for a predetermined period of time to allow the ionized path created by the spark to dissipate. After a predetermined delay, i.e., at a time T4, AVC 40 begins to provide a low amplitude voltage to T/R set 42. AVC 40 may then operate in a full-cycle energization mode for a number of half-cycles of the input voltage in order to increase the amplitude of voltage signal $V_{IE}$ to a useful level in a short period of time. At a time T5, AVC 40 switches back into the intermittent energization mode, and once again, gradually increases the amplitude of voltage signal $V_{IE}$ until another spark occurs within electrostatic elements 14. This cycle is repeated so as to energize electrostatic elements 14 in the intermittent energization mode.

In one embodiment of the present invention, AVCs 40 control the voltage delivered to T/R sets 42 in response to various input signals. These input signals may include, for example, a signal indicative of the boiler load developed by boiler load sensor 34 or a signal indicative of the sulfur flow rate developed by flow rate sensor 33 (FIG. 1). Specifically, AVCs 40 may choose an intermittent duty cycle in response to these signals, or other desired control signals, which results in the most efficient operation of electrostatic precipitator 12. Preferably, AVCs 40 may automatically change the intermittent duty cycle during operation of flue gas conditioning system 8.

As illustrated in FIG. 4, voltage signal $V_{IE}$, produced at transformer outputs 66 and 68, does not drop to a value of zero during the off half-cycles of the intermittent voltage supplied by AVC 40. This is a result of charge being stored in the electrostatic elements 14 during these off half-cycles. (The current signal $I_{IE}$, however, does drop to a value of zero during the off half-cycles of the intermittent voltage.) It should also be noted that the peaks of the voltage signal $V_{IE}$ tend to be greater than those developed by the voltage signal $V_{FCE}$ during the full-cycle energization mode shown in FIG. 3. It is this increase in the peaks of the voltage signal $V_{IE}$, in conjunction with zero current flow during the off half-cycles of the input voltage, which increases the performance of electrostatic precipitator 12 during the intermittent energization mode of operation.

The performance of electrostatic precipitator 12 during the intermittent energization mode, however, is not directly correlated to the operating duty cycle of AVC 40, because the peak voltages produced at transformer outputs 66 and 68 during intermittent energization are not linearly related to the duty cycle of AVC 40. Thus, as the ratio of energized half-cycles to deenergized half-cycles (the duty cycle) is changed, the performance of electrostatic precipitator 12 changes without a direct correlation in the change of average power supplied to electrostatic elements 14. For example, switching from the full-cycle energization mode to the intermittent energization mode with a duty cycle of 33% (i.e., one half-cycle on and two half-cycles off) generally results in the same performance of electrostatic precipitator 12 but also results in electrostatic elements 14 absorbing an average power that is approximately 40% of the average power absorbed by the same electrostatic elements during the full-cycle energization mode.

Thus, the duty cycle used during the intermittent energization mode is not a reliable indication of the power being dissipated by the electrostatic elements 14 and a change in the duty cycle by, for example, 50%, does not necessarily change the average power absorbed by electrostatic elements 14 by 50%. As a result, flow controller 30 cannot rely on a measure of power developed by AVC 40, such as the duty cycle, as an accurate indication of the average power being delivered to electrostatic elements 14, but must, instead, measure the actual power provided to electrostatic elements 14, as disclosed herein, in order to control the flow of $SO_3$ into the flue 9 in a precise manner.

It is, therefore, an important aspect of this invention to measure the precise voltage and the current developed by each T/R set 42 (e.g., the voltage appearing across and the current flowing through electrostatic elements 14) to produce an accurate indication of the power delivered to electrostatic elements 14. This power indication is, preferably, developed from the half-cycle RMS, peak or average value of current signal $I_s$ during each of the energized half-cycles of the input voltage and from the average value of voltage $V_s$, the peak value of voltage $V_s$, the half-cycle RMS value of the voltage $V_s$ or the minimum value of the voltage $V_s$ over one or more energized half-cycles of the input voltage. This power indication could, however, also be developed from the half-cycle RMS, peak or average value of the current flowing through the primary of the transformer 58 and/or from the average, peak, half-cycle RMS or minimum value of the voltage across the primary of the transformer 58 over one or more energized half-cycles of the input voltage. Preferably, if a voltage measurement over a number of predetermined half-cycles is used, the power measuring unit 32 discards any voltage measurements from half-cycles which fall below a predetermined threshold because such measurements tend to occur during the half-cycles of the input voltage immediately following a spark within the electrostatic plates. A power signal, so developed, enables flow controller 30 to control flow of $SO_3$ into flue 9 in a precise and accurate manner, regardless of the intermittent energization duty cycle chosen by AVCs 40. Furthermore, it should be noted that the duty cycle of the intermittent power supply can change during operation thereof without effecting the ability of the power measuring unit 32 to produce an accurate power signal, i.e., a signal which accurately indicates the power being delivered to the electrostatic elements.

Figure 5:
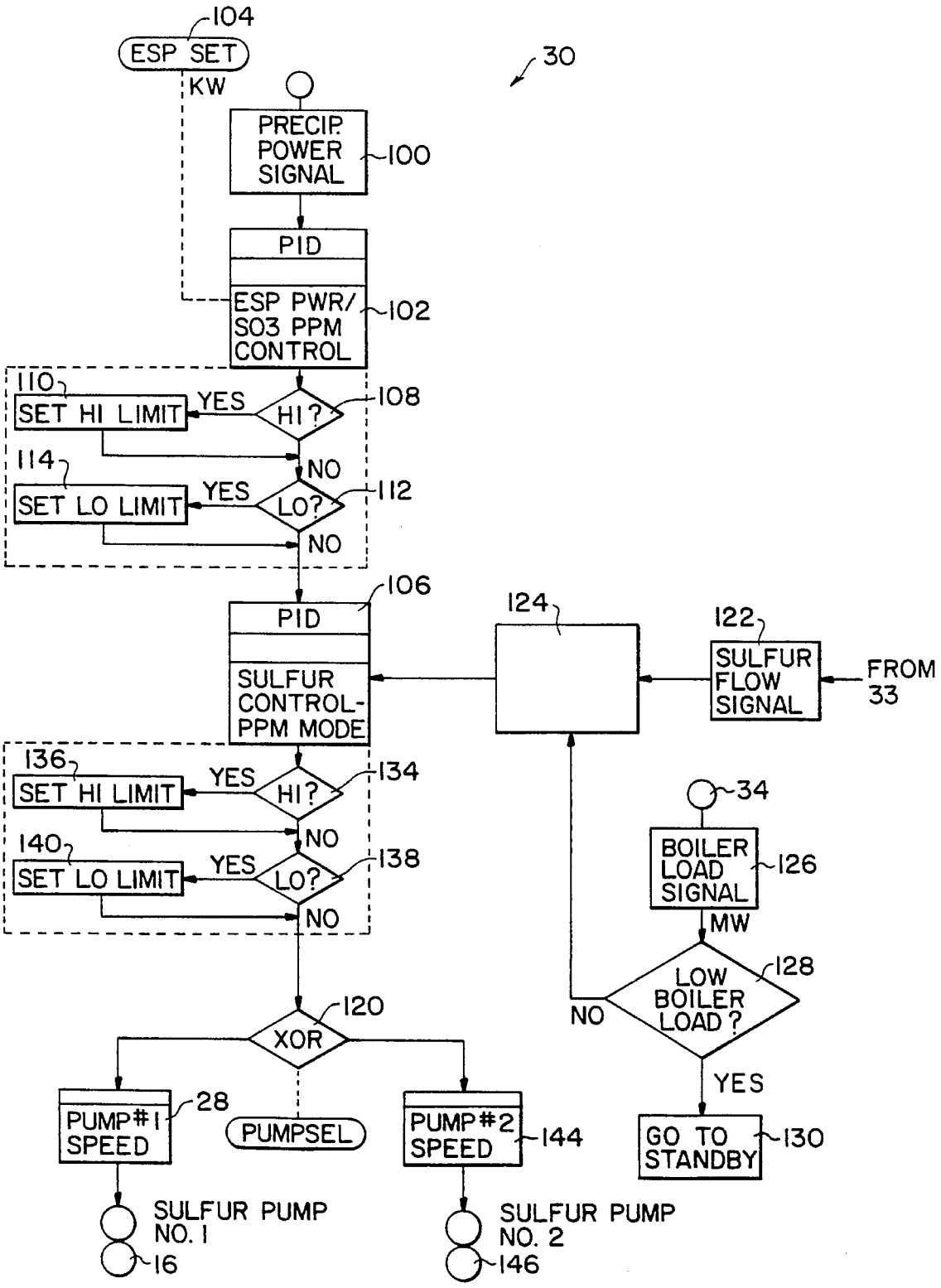
FIG. 5 comprises a flow chart illustrating a flue gas flow controller employed in the system of FIG. 1.

FIG. 5 shows a preferred embodiment of flow controller 30 although any other desired flow controller can be used instead. An electrostatic precipitator power signal 100 is developed, for example, by averaging the outputs of power measuring units 32. Signal 100 is supplied to a process variable input of a proportional-integral-derivative (PID) controller 102. An electrostatic power set point 104 is supplied to a set point input of PID controller 102. PID controller 102 subtracts one of either electrostatic power set point 104 or electrostatic precipitator power signal 100 from the other to develop an error or difference signal. PID controller 102 applies any desired combination of proportional, integral, and derivative control to this error signal to develop an electrostatic precipitator power control quantity for supply to a PID controller 106.

If desired, a comparator 108 tests the electrostatic precipitator power control quantity from PID controller 102 against a high threshold. If the electrostatic precipitator power control quantity is above the high threshold, the electrostatic precipitator power control quantity is then set at a high limit 110. The electrostatic precipitator power control quantity is also compared to a low threshold by a comparator 112. If the electrostatic precipitator power control quantity is below the low threshold, the electrostatic precipitator power control quantity is set at a low limit 114. Accordingly, the electrostatic precipitator power control quantity, or its high limit 110, or its low limit 114 is supplied to PID controller 106.

The output of the PID controller 102 or the output of the comparator 112, which may, for example, represent a percentage, can be converted into a signal representative of any other desired unit before being input into the PID controller 106.

PID controller 106 provides an $SO_3$ control signal, which is based upon a calculated $SO_3$ concentration quantity, to a connection point 120. In order to calculate the $SO_3$ concentration quantity, flow controller 30 receives a sulfur flow signal 122 from, for example, flow rate sensor 33 (FIG. 1). A block 124 applies a proportionality constant K to sulfur flow signal 122.

Furthermore, a boiler load signal 126 is provided by boiler load sensor 34 (FIG. 1), and the boiler load signal may be compared, if desired, by a comparator 128 to a low threshold. If the boiler load signal is below the low threshold, a block 130 initiates a standby condition, at the option of the operator. That is, if boiler 10 is operating at a substantially reduced boiler load, for example below 10% of its rated maximum capacity (i.e., the low threshold), the volume of the flue gas produced by boiler 10 is very low. Consequently, the amount of contaminants is sufficiently low at this volume of flue gas that the injection of $SO_3$ is unnecessary. Thus, in standby, sulfur pump 16 is stopped so that no sulfur is unnecessarily burned by sulfur burner 20 (FIG. 1).

On the other hand, if boiler load signal 126 is not below the low threshold, the boiler load signal 126 is supplied to the block 124 which may comprise a microprocessor or other computing network. The Block 124 performs the following calculation:

$$SO_3PPM = \frac{(\text{Sulfur Flow})\,(460 + T_s)\,(\text{ConverterEff})\,(10^6)\,(387)}{(\text{ACFM})\,(60)\,(530)\,(32)} \quad (1)$$

where $SO_3PPM$ is the $SO_3$ concentration quantity, Sulfur Flow is the sulfur flow signal 122 supplied by flow rate sensor 33, 460 is 460° Rankin which converts the Fahrenheit temperature scale to the absolute temperature scale, $T_s$ is the temperature in degrees Fahrenheit of the flue gas at injectors 25 at which $SO_3$ conditioning agent is injected, ConverterEff is the nominal efficiency of $SO_3$ generator 24 (which may typically be 95%), $10^6$ converts the calculation to parts per million, 387 is the Ideal Gas Constant in cubic feet per pound mole, ACFM is the boiler load (representing the actual cubic feet per minute rate at which flue gas is produced), 60 converts the ACFM rate from cubic feet per minute to cubic feet per hour, 530 is a temperature reference equal to 460° Rankin plus the temperature base for the Ideal Gas Constant, i.e. 70° F., and 32 is the molecular weight of sulfur. Although the temperature of the flue gas may be measured by a sensor (not shown) to produce a signal for $T_s$, the design output temperature of boiler 10 at full boiler load may instead be used for $T_s$.

Equation (1) can be rewritten in a simplified form as follows:

$$C_{SO_3}=K(F_s/L_B) \quad (2)$$

where $C_{SO_3}$ is the $SO_3$ concentration quantity in parts per million, $F_s$ is the sulfur flow signal 122 supplied by flow rate sensor 33, i.e., Sulfur Flow of equation (1), $L_B$ is boiler load signal 126 supplied by boiler load sensor 34, i.e., ACFM of equation (1), and K is the scaling factor applied to the sulfur flow signal 122 and is the collection of all terms on the right-hand side of equation (1) other than Sulfur Flow and ACFM.

Since other types of conditioning agents may be supplied to the flue gas produced by boiler 10, since any type of burner 20 can be used for boiler 10, and since it is possible to directly measure the rate at which the conditioning agent is supplied to the flue gas, equation (2) can be further generalized according to the following equation:

$$C_{CA}=K_1(F_{CA}/L_B') \quad (3)$$

where $C_{CA}$ is the conditioning agent concentration quantity, $F_{CA}$ is a flow rate related to the rate at which the conditioning agent is supplied to the flue gas, $L_B'$ is boiler load (i.e., related to the rate at which flue gas is produced), and $K_1$ is a scaling factor appropriate to the sensors which measure $F_{CA}$ and $L_B'$ and to the particular conditioning agent which is selected for the treatment of the flue gas.

Referring again to FIG. 5, the $SO_3$ concentration quantity calculated by block 124 is supplied to a process variable input of PID controller 106. PID controller 106 produces an error signal by subtracting (a) the electrostatic precipitator power control quantity developed by the PID controller 102 from (b) the calculated $SO_3$ concentration quantity supplied by block 124. PID controller 106 applies any desired combination of proportional, integral, and derivative control to this error signal to develop the $SO_3$ control signal delivered to connection point 120.

If desired, a comparator 134 tests the $SO_3$ control signal against a high threshold. If the $SO_3$ control signal is above the high threshold, the $SO_3$ control signal is then set at a high limit 136. The $SO_3$ control signal is also compared to a low threshold by a comparator 138. If the $SO_3$ control signal is below the low threshold, the $SO_3$ control signal is set at a low limit 140. Accordingly, the $SO_3$ control signal; or its high limit 136, or its low limit 140 is supplied to connection point 120.

The output of $SO_3$ connection point 120 is supplied to speed controller 28 in order to control sulfur pump 16. Alternatively, the output of the connection point 120 may be supplied to a speed controller 144 in order to control a second pump 146.

As indicated in FIG. 5, the electrostatic precipitator power control quantity developed by PID controller 102 is used as the set point for PID controller 106. As a result, the rate at which $SO_3$ is supplied to the flue gas in flue 9 is controlled in order to achieve a balance between sulfur flow signal 122, boiler load signal 126, and the electrostatic precipitator power consumed by electrostatic precipitator 12 as sensed by power measuring units 32. Thus, if it is assumed, for example, that the power consumed by electrostatic precipitator 12 decreases, its efficiency in removing ash from the flue gas in flue 9 decreases. As the power consumed by electrostatic precipitator 12 decreases, electrostatic precipitator power signal 100 decreases. PID controller 102 is arranged so that a decrease in electrostatic precipitator power signal 100 results in an increase in the electrostatic precipitator power control quantity produced by PID controller 102. An increase in the electrostatic precipitator power control quantity results in an increase of the set point of PID controller 106. As the set point of PID controller 106 increases, the $SO_3$ control signal changes in a direction to increase the speed of pump 16 thereby to increase sulfur flow, i.e., the $SO_3$ control signal increases. As a result, $SO_3$ is supplied to the flue gas at a faster rate in order to increase the efficiency of electrostatic precipitator 12 and to consequently increase the power consumed by electrostatic precipitator 12. As the flow of sulfur increases, sulfur flow signal 122 increases to increase the calculated $SO_3$ concentration quantity until a balance is achieved between sulfur flow signal 122, boiler load signal 126, and the electrostatic precipitator power consumed by electrostatic precipitator 12 as sensed by power measuring units 32.

Flow controller 30 as disclosed in FIG. 5, may be implemented utilizing known analog hardware elements. Alternatively, flow controller 30 may be implemented by a microprocessor and a program which performs the functions of the elements disclosed in FIG. 5.

The source of sulfur trioxide is shown in FIG. 1 as comprising a source of sulfur 18, a burner 20 for converting the sulfur to sulfur dioxide in the presence of oxygen (from an air blower 22) and an $SO_3$ generator 24, such as a catalytic converter, for converting the sulfur dioxide into sulfur trioxide. However, any suitable source of $SO_3$ can be used; for example, a source of liquid $SO_2$ may be provided which can be vaporized and combined with air to be converted by a catalytic converter into sulfur trioxide, $SO_3$; or sulfur trioxide ($SO_3$) can be supplied directly by vaporizing liquid $SO_3$ from a supply thereof. Electrostatic precipitator 12 may be any of the commercially available electrostatic precipitators. Also, an Allen-Bradley, Model 1771 controller may be used as the flow controller shown at 30 in FIG. 1, instead of using the Honeywell UDC 9000E controller.

Furthermore, even though specific values for limits, constants, ranges and the like have been shown, it will be appreciated that any other desired values may be used. These and other modifications will be apparent to one skilled in the art and lie within the present invention, the scope of which is determined only by the following claims.

I claim:

1. A method of controlling a flue gas conditioning system including a source of a conditioning agent, means for adding the conditioning agent to a flue gas, an electrostatic precipitator for treating the flue gas and having a set of electrostatic elements which receive an intermittent input power, a power supply which operates in an intermittent energization mode to deliver the intermittent input power to the electrostatic precipitator, and a controller, for controlling the amount of the conditioning agent added to the flue gas, said method comprising the steps of:

measuring first and second parameters of the intermittent input power delivered to the electrostatic precipitator;

deriving a power signal, indicative of the intermittent input power delivered to the electrostatic precipitator, from the first and second parameters; and controlling the amount of conditioning agent added to the flue gas according to the power signal; wherein the input power includes a plurality of energized and non-energized half-cycles; and the step of measuring includes the step of (a) detecting the first parameter existing at the electrostatic precipitator during an energized half-cycle of the input power and (b) detecting the second parameter existing at the electrostatic precipitator during an energized half-cycle of the input power.

2. The method of claim 1, wherein:

the power supply includes a transformer having a secondary winding coupled to the electrostatic precipitator; and the step of measuring includes the step of detecting the first and second parameters of the intermittent input power at the secondary winding of the transformer.

3. The method of claim 1, wherein:

the power supply includes a transformer having a primary winding coupled to a power source; and the step of measuring includes the step of detecting the first and second parameters of the intermittent input power at the primary winding of the transformer.

4. A method of controlling a flue gas conditioning system including a source of a conditioning agent, means for adding the conditioning agent to a flue gas, an electrostatic precipitator for treating the flue gas and having a set of electrostatic elements which receive an input power, a power supply which operates in an intermittent energization mode to deliver the input power to the electrostatic precipitator, and a controller, for controlling the amount of the conditioning agent added to the flue gas, said method comprising the steps of:

measuring first and second parameters of the input power delivered to the electrostatic precipitator;

deriving a power signal indicative of the input power delivered to the electrostatic precipitator from the first and second parameters; and controlling the amount of conditioning agent added to the flue gas according to the power signal;

wherein:

the input power includes a plurality of energized and non-energized half-cycles;

the first and second parameters are current and voltage, respectively; and the step of measuring includes the step of detecting a current flowing to the electrostatic precipitator during an energized half-cycle of the input power and detecting a voltage developed across the electrostatic precipitator during the energized half-cycle of the input power.

5. The method of claim 4, wherein the step of detecting a current includes detecting one of the half-cycle RMS current, the peak current or the average current flowing to the electrostatic elements; and the step of detecting a voltage includes detecting one of the peak voltage, the average voltage, the half-cycle RMS voltage or the minimum voltage developed across the electrostatic elements.

6. The method of claim 5, wherein:

the step of deriving includes-the step of combining signals indicative of the detected current and the detected voltage to produce the power signal indicative of the input power.

7. The method of claim 6, wherein the step of combining includes:

multiplying the current signal with the voltage signal to produce the power signal indicative of the input power.

8. The method of claim 4, wherein:

the power supply includes a transformer having a secondary winding coupled to the electrostatic precipitator; and the step of measuring includes the step of detecting the first and second parameters of the input power at the secondary winding of the transformer.

9. The method of claim 4, wherein:

the power supply includes a transformer having a primary winding coupled to a power source; and the step of measuring includes the step of detecting the first and second parameters of the input power at the primary winding of the transformer.

10. A method of controlling a flue gas conditioning system including a source of a conditioning agent, means for adding the conditioning agent to a flue gas, an electrostatic precipitator for treating the flue gas and having a set of electrostatic elements which receive an input power, a power supply which operates in an intermittent energization mode to deliver the input power to the electrostatic precipitator, and a controller, for controlling the amount of the conditioning agent added to the flue gas, said method comprising the steps of:

measuring first and second parameters of the input power delivered to the electrostatic precipitator;

deriving a power signal indicative of the input power delivered to the electrostatic precipitator from the first and second parameters; and controlling the amount of conditioning agent added to the flue gas according to the power signal;

wherein:

the input power includes energized and non-energized half-cycles;

the first and second parameters are current and voltage, respectively; and the step of measuring includes the step of detecting a current flowing to the electrostatic precipitator during a plurality of the energized half-cycles of the input power and detecting a voltage developed across the electrostatic precipitator during the plurality of the energized half-cycles of the input power.

11. The method of claim 10, wherein the step of detecting a current includes detecting one of the half-cycle RMS current, the peak current or the average current flowing to the electrostatic elements; and the step of detecting a voltage includes detecting one of the peak voltage, the average voltage, the half-cycle RMS voltage or the minimum voltage developed across the electrostatic elements.

12. The method of claim 10, wherein:

the step of deriving includes the step of combining signals indicative of the detected current and the detected voltage to produce the power signal indicative of the input power.

13. The method of claim 12, wherein the step of combining includes:

multiplying the current signal with the voltage signal to produce the power signal indicative of the input power.

14. The method of claim 10, wherein:

the power supply includes a transformer having a secondary winding coupled to the electrostatic precipitator; and the step of measuring includes the step of detecting the first and second parameters of the input power at the secondary winding of the transformer.

15. The method of claim 10, wherein:

the power supply includes a transformer having a primary winding coupled to a power source; and the step of measuring includes the step of detecting the first and second parameters of the input power at the primary winding of the transformer.

* * * * *